US005231773A

United States Patent [19]

Pabst

[11] Patent Number: 5,231,773

[45] Date of Patent: Aug. 3, 1993

[54] EXHAUST PRODUCTS HANDLING METHOD AND APPARATUS FOR A MACHINE WHICH APPLIES TREATMENT FLUID TO A LENGTH OF MATERIAL

[75] Inventor: Manfred Pabst, Cologne, Fed. Rep. of Germany

[73] Assignee: A. Monforts GmbH & Co., Monchen-Gladbach, Fed. Rep. of Germany

[21] Appl. No.: 747,008

[22] Filed: Aug. 19, 1991

[30] Foreign Application Priority Data

Aug. 17, 1990 [DE] Fed. Rep. of Germany ..... 4026106

[51] Int. Cl.[5] ..... F26B 3/00

[52] U.S. Cl. ..... 34/29; 34/32; 34/72; 34/79; 34/155

[58] Field of Search ..... 34/155, 235, 205, 209, 34/210, 224, 225, 86, 29, 34–35, 72, 32

[56] References Cited

U.S. PATENT DOCUMENTS

| | | | |
|---|---|---|---|
| 3,829,985 | 8/1974 | Durr et al. | 34/155 |
| 3,849,904 | 11/1974 | Villalobos | 34/155 |
| 4,116,620 | 9/1978 | Stibbe | 34/155 |
| 4,127,945 | 12/1978 | Nothen et al. | 34/155 |
| 4,137,648 | 2/1979 | Rhodes | 34/86 |
| 4,169,321 | 10/1979 | Nichols | 34/155 |
| 4,231,165 | 11/1980 | Gresens et al. | 34/86 |

FOREIGN PATENT DOCUMENTS

| | | |
|---|---|---|
| 0073915B1 | 4/1983 | European Pat. Off. . |
| 2727971A1 | 1/1979 | Fed. Rep. of Germany . |
| 2812966A1 | 10/1979 | Fed. Rep. of Germany . |
| 3312226A1 | 10/1984 | Fed. Rep. of Germany . |
| 3336331C2 | 12/1985 | Fed. Rep. of Germany . |

*Primary Examiner*—Henry A. Bennet

*Assistant Examiner*—Denis Gromada

*Attorney, Agent, or Firm*—Shefte, Pinckney & Sawyer

[57] ABSTRACT

A method and apparatus are provided for handling the exhaust products produced during a treatment process in which treatment fluid is applied to a length of material. Several types of machines used in the textile industry and in the paper industry are operable to apply treatment fluid to a length of material in a treatment process during which exhaust products are created and some of the exhaust products comprise pollutants while other exhaust products are substantially pollutant-free. The present invention provides an exhaust products handling apparatus including an exhaust manifold connected to all the treatment zones of a treatment fluid applying machine, a discharge assembly connected to the exhaust manifold for drawing exhaust products away from the treatment zones, and a selective communicating device for selectively communicating the discharge assembly through the exhaust manifold, with a respective one of at least two different groups of treatment zones. The selective communicating device is movable between a first configuration in which the discharge assembly is communicated with a first group of treatment zones and a second configuration in which the discharge assembly is communicated with a second different group of treatment zones. Accordingly, those exhaust products which are substantially pollutant-free can be routed along one path in which they are directly released to the atmosphere without conditioning while those exhaust products comprising pollutants can be routed along a different path to a reconditioning device which removes or neutralizes pollutants in the exhaust products before releasing the exhaust products to the atmosphere.

9 Claims, 1 Drawing Sheet

EXHAUST PRODUCTS HANDLING METHOD AND APPARATUS FOR A MACHINE WHICH APPLIES TREATMENT FLUID TO A LENGTH OF MATERIAL

BACKGROUND OF THE INVENTION

The present invention relates to an exhaust products handling apparatus for a machine which applies treatment fluid to a length of material and, more particularly, a machine for applying heated treatment fluid in a treatment process in which heated exhaust products are created which may require removal or neutralization of pollutant components thereof before release to the atmosphere.

In machines particularly designed for applying treatment fluid to a traveling length of material such as, for example, machines of the type used in the textile and paper industries which continuously apply treatment fluid to a traveling web of material, exhaust products such as gases which include heated air are created during the treatment process and the volume and character of these exhaust products can vary at different treatment locations along the extent of the machine. For example, in a textile machine for applying treatment fluid to a web of textile material such as, for example, a tenter frame, a typical treatment process involves initially drying the web of textile material and thereafter subjecting the web to a fixing or condensation treatment, depending upon the type of fiber comprising the textile material, the desired color, and other parameters. Although it is not uncommon for large quantities of steam to be created at the locations of the machine at which the drying of the web of textile material occurs, the steam as an exhaust product is typically in such a clean state—e.g. free of pollutants—it can be released directly to the atmosphere without further conditioning or handling. On the other hand, the exhaust products created during the fixing cr condensation treatment of the web often comprise chemical components which must be removed or neutralized before the exhaust products can be released and, accordingly, special exhaust product reconditioning devices must be provided for reconditioning such pollutant-laden exhaust products.

Since the operating cost for reconditioning pollutant-laden exhaust products is not insignificant, it is desirable to minimize the volume of exhaust products handled by such special devices. Although one approach to minimizing the volume of exhaust products conditioned by such special devices is to channel the pollutant-free exhaust products (e.g., steam) along a separate route to be vented directly to the atmosphere, difficulties arise in implementing this solution due to the variable nature of the "border" between the "drying" area of the machine in which the drying process occurs and the other area of the machine in which the fixing or condensation occurs. For example, the area of the machine devoted to the drying process may be increased or decreased depending upon increases or decreases in the speed of travel of the textile material web through the machine; changes in the material composition of the web itself; the travel through the machine of portions of the web which have been subjected to different pretreatment steps than other portions of the web; or changes in the operating temperature of the machine. Accordingly, the need exists for an exhaust products handling apparatus having the flexibility to accommodate variations in the location of the "border" between different treatment regions of the machine which produce exhaust products having different characteristics.

SUMMARY OF THE INVENTION

The present invention provides an exhaust products handling apparatus having a communicating means to selectively communicate the treatment yarns with a discharge assembly. The communicating means is operable to selectively vary the treatment zones communicated with the discharge assembly to thereby provide flexibility for accommodating variations in the location of the "border" between different treatment regions of the treatment fluid applying machine.

Briefly described, the present invention provides an exhaust products handling apparatus in a machine for applying treatment fluid to a length of material in a treatment process during which exhaust products are created, the machinery having a plurality of treatment zones each for applying treatment fluid at a different application location. The apparatus includes an exhaust manifold operatively connected at least two of the treatment zones for the passage of exhaust products therethrough being drawn away from the treatment zones and a discharge assembly connected to the exhaust manifold for drawing exhaust products away from those treatment zones with which it is communicated through the exhaust manifold. Also, the apparatus includes means, operatively connected to the exhaust manifold, for communicating the first discharge assembly with at least one of the treatment zones, the communicating means being manipulable to selectively vary the treatment zones selected for communication with the discharge assembly.

According to one aspect of the present invention, the exhaust products handling apparatus further comprises a second discharge assembly, connected to the exhaust manifold, for drawing exhaust products away from at least one of the treatment zones that is not communicating with the first discharge assembly. Also, the communicating means is preferably selectively manipulable to selectively vary the treatment zones communicating with the second discharge assembly.

According to one feature of the apparatus, the exhaust manifold includes a pair of opposed ends, the first discharge assembly being connected to the exhaust manifold at one opposed end thereof and the second discharge assembly being connected to the exhaust manifold at the other opposed end thereof.

According to another feature of the apparatus, a plurality of outlet conduits is provided, each connecting a respective treatment zone to the exhaust manifold at a connecting location thereon, the connecting locations being at spaced intervals from one another along the extent of the exhaust manifold and the communicating means includes at least one flow blocking element movable between a blocking position for blocking the flow therepast of exhaust products at a blocking location on the exhaust manifold between an adjacent pair of the connecting locations at which the outlet conduits are connected to the exhaust manifold and a flow position at which the flow blocking element permits the flow of exhaust products past the blocking location. In the another feature of the apparatus, the communicating means preferably includes a plurality of flow blocking elements each for selectively blocking the flow of exhaust products past an associated blocking position on the exhaust manifold between a respective adjacent pair of the connecting locations.

In one aspect of the another feature of the apparatus, each flow blocking element includes a throttle valve having a threaded stem portion and a blocking member connected to the threaded stem portion, each throttle valve being movably supported in the exhaust manifold and being operable to move its respective blocking member into a position in which it blocks the flow of exhaust products therepast and a position in which the blocking member does not completely block the flow of exhaust products therepast.

According to a different aspect of the present invention, a method of handling exhaust products created during a treatment process in which treatment fluid is applied to a length of material is provided. The method includes manipulating a communicating means to communicate a first discharge assembly through an exhaust manifold with at least one selected treatment zone for drawing away exhaust products therefrom which are created during the application of treatment fluid to the length of material therein. Also, the method includes manipulating the communicating means to communicate a second discharge assembly through the exhaust manifold with at least one treatment zone not communicated with the first discharge assembly for drawing away exhaust products therefrom which are created during the application of treatment fluid to the length of material therein, the second discharge assembly having an exhaust products reconditioning device associated therewith for selectively removing or otherwise neutralizing pollutants comprised in the exhaust products handled thereby. Finally, the method includes manipulating the communicating means to vary the treatment zones communicated with the first and second discharge assemblies.

DESCRIPTION OF THE PREFERRED EMBODIMENT

Figure 1:
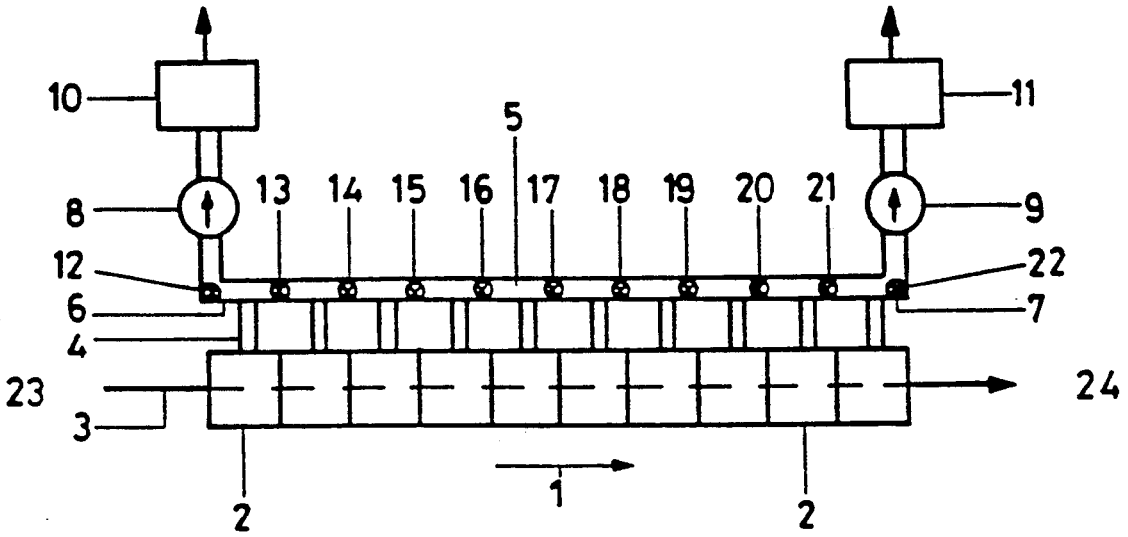
FIG. 1 is a front elevational schematic view of a preferred embodiment of the exhaust products handling apparatus of the present invention.

In FIG. 1, the preferred embodiment of the exhaust products handling apparatus of the present invention is illustrated in its operating configuration for handling the exhaust products of a conventional machine for applying treatment fluid to a length of material such as, for example, a tenter frame which is operable to apply a drying treatment or both a drying treatment and a fixing or condensation treatment to a traveling web of textile material 3. The tenter frame comprises a plurality of individual treatment zones 2 serially arranged between an entrance end 23 and an exit end 34 of the tenter frames in the direction of travel 1 of the web 3 and the treatment zones 2 can be structured and operated as described, for example, in German Patentschrift 33 36 331.

During operation of the tenter frame, the web 3 continuously travels sequentially through the treatment zones 2 in the transport direction 1 and, during this travel, is subjected to treatment processes within the treatment zones which include the application of treatment fluids to the web 3. The treatment fluid may be solely comprises of heated treatment gas having air as one of its components or the treatment fluid may comprise a gas and liquid combination.

The exhaust products handling apparatus of the present invention is operable to handle the exhaust products created during the treatment of the web 3 in the tenter frame and the apparatus includes an exhaust manifold 5 individually connected with each treatment zone 2 via a respective one of a plurality of outlet conduits 4 for the passage of exhaust products through the exhaust manifold 5 which are being drawn away from the treatment zones 2. The exhaust manifold 5 is preferably in the form of a pipe with the outlet conduits 4 being connected to the pipe at uniform spacings therealong.

The exhaust products handling apparatus also includes a first discharge assembly 8, operatively connected to one end 6 of the exhaust manifold 5, for drawing exhaust products away from the treatment zones with which it is communicated through the exhaust manifold 5. The first discharge assembly 8 includes a conventional suction device for creating suction along the exhaust manifold 5 and through the outlet conduits 4 to effect drawing away of exhaust products from the treatment zones 2. A first exhaust gas reconditioning device 10 is operatively connected to the first discharge assembly 8 upstream of the suction device thereof relative to the direction of flow of exhaust products through the first discharge assembly for selectively conditioning the exhaust products to remove or eliminate certain pollutant components thereof.

The exhaust products handling apparatus additionally includes a second discharge assembly 9, operatively connected to the other end 7 of the exhaust manifold 5, for drawing exhaust products away from those treatment zones 2 with which it is communicated through the exhaust manifold. The second discharge assembly 9 includes a conventional suction device (not shown) for creating suction for drawing exhaust products through the outlet conduits 4 and along the exhaust manifold 5 for passage through the second discharge assembly 9 to a second exhaust products reconditioning device 11 is operatively connected to the second discharge assembly 9 upstream of the flow of exhaust products therethrough for removing and/or eliminating certain pollutant components of exhaust products passed therethrough.

The exhaust products handling apparatus further includes a means for communicating the first discharge assembly 8, through the exhaust manifold 5, with at least one treatment zones 2. The communicating means is manipulable to selectively vary the treatment zones communicated with the first discharge assembly 8 and includes a plurality of adjustable throttle valves 12–22, each throttle valve comprising a threaded stem portion and a pipe blocking member connected to its threaded stem portion. Each throttle valve 12–22 is threadably mounted in the exhaust manifold 5 for rotation of each throttle valve between a blocking position in which its pipe blocking member blocks the flow therepast of exhaust products at a blocking location on the exhaust manifold 5 and a flow position at which the pipe blocking member permits the flow of exhaust products past the blocking location.

The throttle valve 12 is positioned at a blocking location at the one end 6 of the exhaust manifold 5 intermediate the connecting location at which the respective outlet conduit 4 connects the first treatment zone 2 to the exhaust manifold 5 (relative to the transport direction 1). The throttle valve 22 is disposed at a blocking location at the other end 7 of the exhaust manifold 5 intermediate the second discharge assembly 9 and the connecting location at which the respective outlet conduit 4 of the sequentially last treatment zone 2 is connected to the exhaust manifold 5 (relative to the transport direction 1). The other throttle valves 13–21 are each disposed at a respective blocking location intermediate an adjacent pair of connecting locations at which the outlet conduits 4 of a respective pair of adjacent treatment zones are located on the exhaust manifold 5.

The operation of the exhaust products handling apparatus will be described in connection with three different configurations thereof which are each associated with a respective treatment process profile graphically represented in FIG. 2. In a first configuration, the web 3 is to be subjected solely to a drying treatment process for drying the web from a wet condition to a "dry" condition. The temperature of each respective portion of the web 3 traveling through the tenter frame follows a progression schematically illustrated by the plot 25 between its entry into the tenter frame at the entrance end 23 and its exit from the tenter frame at the exit end 24. Each respective portion of the web 3 is initially at an entrance temperature which rises shortly after its travel beyond the entrance end 23 of the tenter frame to a cooling limit temperature Tg and the temperature of the respective portion remains essentially at the cooling limit temperature Tg until, shortly before the exit of the respective portion of the web 3 at the exit end 24, the temperature of the respective portion rises again to an exit temperature Tt and this rise of temperature to the exit temperature Tt is an indication that the web 3 has reached a dry status.

Typically, the drying of the web 3 is accomplished by the application of a treatment fluid exclusively or substantially comprising only heated air and the exhaust products, except at those treatment zones 2 downstream of the treatment zone at which the temperature of the web 3 has risen to the exit temperature Tt, consist essentially of only steam which can be regarded as an essentially pollution-free exhaust product. Accordingly, the steam exhaust products can be released to the atmosphere without further conditioning of the exhaust products to remove or eliminate certain components thereof and the exhaust products handling apparatus can be configured in a first configuration to separately handle the steam exhaust products differently than the exhaust products emanating from those locations at which the web 3 is at the exit temperature Tt. Specifically, the exhaust products handling apparatus is configured in its first configuration for handling the web 3 during the treatment process resulting in the temperatures graphically represented by the plot 25 by manipulating the throttle valve 21 to its blocking position and manipulating the remaining throttle valves 12–20 and 22 to their non-blocking positions. With the throttle valves 12–22 positioned as described in their respective blocking and non-blocking positions, the exhaust products created in all of the treatment zones to save for the sequentially last treatment zone are communicated through the exhaust manifold 5 with the first discharge assembly 8 and the suction device of the first discharge assembly 8 therefore operates to draw away the exhaust products from this first group of treatment zones through the exhaust manifold 5 to the first discharge assembly. Since the exhaust products from the first group of treatment zones consists essentially of pollutant-free steam, the first exhaust products reconditioning device 10 is not actuated and, instead, the steam is passed directly through the first discharge assembly 8 and released to the atmosphere without any reconditioning thereof.

Due to the position of the throttle valve 21 in a blocking position intermediate the next to the last and the sequentially last treatment zones 2, the exhaust products of the sequentially last treatment zone cannot flow along the exhaust manifold past the throttle valve 21. However, since the throttle valve 22 at the end 7 of the exhaust manifold 5 is in its nonblocking position, the second discharge assembly 9 is operable to draw away the exhaust products of the sequentially last treatment zone for passage to the second exhaust products reconditioning device 11 for conditioning of the exhaust products thereat. Thus, the exhaust products of the sequentially last treatment zone 2—which is the treatment zone in which the temperature of the web 3 rises to the exit temperature Tt at which exhaust products are produced which comprise pollutants—the exhaust products are drawn away by the second discharge assembly 9 and further conveyed to the second exhaust products reconditioning device 11 for elimination or removal of the pollutants from the exhaust products and, thereafter, the release of the now-cleansed exhaust products to the atmosphere. The exhaust products handling apparatus therefore advantageously minimizes the volume of exhaust products to be handled by the exhaust products reconditioning devices.

In the event that the web 3 is to be treated in a different treatment process in which the web is subjected both to a drying treatment and a fixing or condensation treatment, the exhaust products handling apparatus can be readily reconfigured from its present configuration such as, for example, its first configuration for handling the textile web 3 in a treatment process in which the web temperature follows the plot 25, to a second configuration for handling the exhaust products created during this different treatment process. In this different treatment process, the temperature of each respective portion of the web 3 follows a progression graphically illustrated by the plot 26 in FIG. 2 in which each respective portion of the web 3 enters the entrance end 23 of the tenter frame at an entrance temperature and rises shortly thereafter to the cooling limit temperature Tg. At approximately halfway through the travel of the respective portion of the web 3 through the tenter frame, the temperature of the respective portion rises from the cooling limit temperature Tg to a fixing temperature Tf and this temperature transition occurs as the drying step of the treatment process for drying the respective portion of the web 3 is completed and the fixing or condensation step commences.

The fixing or condensation temperature Tf is typically substantially the same as the temperature of the heated treatment fluid being applied to the web 3. At this increased temperature higher than the cooling limit temperature Tg, exhaust products are created which are laden with pollutants of the type which must be removed or neutralized before the exhaust products can be released to the atmosphere. Accordingly, it is desirable to the conduct the exhaust products from those ones of the treatment zones 2 at which the web 3 is at the fixing or condensation temperature Tf to an exhaust products reconditioning device. Since the group of treatment zones 2 involved in the drying process create exhaust products which are comprised substantially only of steam which requires no reconditioning, an efficient arrangement results from configuring the exhaust products handling apparatus to separately conduct the steam exhaust products from the first group of treatment zones 2 to the first discharge assembly 8 while maintaining the first exhaust products reconditioning device 10 associated with that discharge assembly in a de-activated condition so that the steam exhaust products are passed directly from the first discharge assembly 8 to the atmosphere without reconditioning and separately routing the exhaust products from the group of the treatment zones 2 associated with the fixing or condensation process at which the web 3 reaches the relatively higher fixing or condensation temperature Tf to the second exhaust products reconditioning device for removal or neutralization of the pollutants by that device.

The second configuration of the exhaust products handling apparatus accommodates the above-described considerations regarding efficient handling of the exhaust products by providing an arrangement by which the respective one of the throttle valves 12–22 at the "border" between the two groups of treatment zones each respectively associated with either the drying process or the fixing or condensation process, is manipulated to position its blocking member in a blocking position while the remaining throttle valves 12–17 and 19–22 are manipulated to their non-blocking positions. Through this configuration of the throttle valves, the exhaust products of all of the treatment zones 2 which pass into the exhaust manifold 5 on the one side of the closed throttle valve 18 toward the one end 6 of the exhaust manifold (i.e., the treatment zones associated with the drying process) are drawn through the exhaust manifold 5 by the first discharge assembly 8 for direct release to the atmosphere. The exhaust products of those treatment zones 2 associated with the fixing or condensation process which flow into the exhaust manifold 5 on the other side of the closed throttle valve 18 toward the other end 7 of the exhaust manifold 5 are drawn by the second discharge assembly 9 through the exhaust manifold and passed onto the second exhaust products reconditioning device 11 which eliminates or removes the pollutants from the exhaust products and then releases the cleansed exhaust products to the atmosphere.

The determination that the one throttle valve 18 is the particular throttle valve at the "border" or transition location between the first group of the treatment zones associated with the drying process and the second group of the treatment zones 2 associated with the fixing or condensation process can be made in consideration of data provided by a measuring device of the type disclosed, for example, in German Patentschrift 32 80 120. A measuring device of this type can be operated to measure the temperature of the traveling web and the measurement of a relatively higher temperature such as, for example, the fixing or condensation temperature Tf, can be taken as an indication that the exhaust products from those treatment zones in which the web is at a higher temperature should be conducted to an exhaust products reconditioning device for reconditioning of the exhaust products. The "border" between the two groups of the treatment zones 2 may vary depending upon certain parameters of the treatment process. For example, if the speed of travel of the web 3 through the tenter frame is increased or decreased, the temperature at which the web is considered have reached a "dry" state may vary, or respective following portions of the web which have been subjected to different pre-treatment than the respective leading portions of the web, a throttle valve other than the throttle valve 18 can be manipulated to a blocking position and the throttle valve 18 can be manipulated from its blocking position to its non-blocking position. The arrangement of the plural throttle valves 12–22 permits ready re-configuration of the exhaust products handling apparatus by a single operator and, if desired, an appropriate remote control assembly can be provided by which an operator can effect manipulation of the throttle valves 12–22 between their blocking and non-blocking positions from a remote location.

Figure 2:
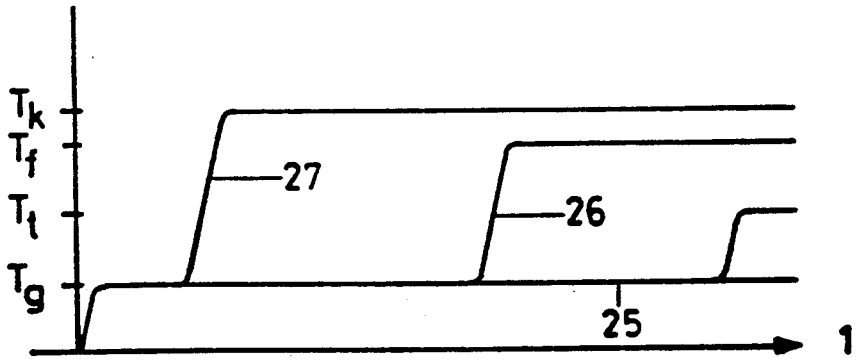
FIG. 2 is a graphical representation of several configurations of the exhaust products handling apparatus shown in FIG. 1.

A third configuration of the exhaust products handling apparatus is particularly suited for handling the exhaust products created during the treatment process for the web 3 in which the temperature of the web follows a progression graphically represented by the plot 27 in FIG. 2. In this treatment process, the web 3 enters the tenter frame at its entrance end 23 at an entrance temperature which rises shortly thereafter to the cooling limit temperature Tg. After passage of the respective portion of the web 3 through, say, the initial treatment zone 2 and the next in sequence treatment zone 2, the temperature rises from the cooling limit temperature Tg to a condensation temperature Tk and this rise in temperature occurs due to the commencement of a fixing or condensation step which follows after the short drying step performed during the passage of the respective portion of the web 3 through the first two treatment zones 2. The third configuration of the exhaust products handling apparatus is arranged to accommodate the different types of exhaust products produced during the treatment of the web 3 in the tenter frame and, to this end, the one throttle valve 14 is manipulated to its blocking position while the remaining throttle valves 12,13 and 15–22 are manipulated to their non-blocking positions. The exhaust products from the first two treatment zones are of the type typically associated with the drying process—namely, exhaust products substantially comprising only steam—and this steam is drawn through the exhaust manifold 5 by the first discharge assembly 8 and released directly to the atmosphere without any reconditioning by the first exhaust products reconditioning device 10, which is maintained in a deactivated status. On the other hand, the exhaust products of the other treatment zones 2 associated with the fixing or condensation treatment of the web 3 are drawn by the second discharge assembly 9 through the exhaust manifold 5 and passed onto the second exhaust products reconditioning device 11 for elimination or neutralization of the pollutants in the exhaust products before their release to the atmosphere.

The exhaust products handling apparatus also provides the flexibility to handle exhaust products in a situation in which all of the treatment zones 2 of the tenter frame are operated to perform the same drying step or the same fixing or condensation step so that the exhaust products of all of the treatment zones have substantially the same characteristics. For example, if all of the treatment zones 2 of the tenter frame are operated to perform a drying step on the web 3, their exhaust products will substantially comprise only steam and so there is no need to conduct any exhaust products to an exhaust products reconditioning device. In this situation, the throttle valve 22 located at the other end 7 of the exhaust manifold 5 is manipulated to its blocking position and all of the remaining throttle valves 12-21 are manipulated to their non-blocking positions so that all of the exhaust products are drawn by the first discharge assembly 8 through the exhaust manifold 5 and released directly to the atmosphere. Conversely, if all of the treatment zones 2 are operated to perform a fixing or condensation step on the web 3, the exhaust products released by each treatment zone will typically comprise pollutants and it will accordingly be necessary to condition the exhaust products before releasing the exhaust products to the atmosphere. In this situation, the throttle valve 12 at the one end 6 of the exhaust manifold 5 is manipulated to its blocking position and the remaining throttle valves 13-22 are manipulated to their non-blocking positions so that all of the exhaust products are drawn by the second discharge assembly 9 through the exhaust manifold 5 and passed onto the second exhaust products reconditioning device 11 for removal or neutralization of the pollutants in the exhaust products.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In a machine for applying treatment fluid to a length of material in a treatment fluid to a length of material in a treatment process during which exhaust products are created, the machinery having a plurality of treatment zones each for applying treatment fluid at a different application location, an exhaust products handling apparatus comprising:

an exhaust manifold operatively connected to at least two of the treatment zones for the passage of exhaust products therethrough being drawn away from the treatment zones;

a first discharge assembly connected to the exhaust manifold for drawing exhaust products away from those treatment zone. with which it is communicated through the exhaust manifold;

a second discharge assembly, connected to the exhaust manifold, for drawing exhaust products away from at least one of the treatment zones that is not communicated with the first discharge assembly; and means, operatively connected to the exhaust manifold, for communicating the first discharge assembly with at least one of the treatment zones, the communicating means being manipulable to selectively vary the treatment zones selected for communication with the discharge assembly.

2. In a machine, an exhaust products handling apparatus according to claim 1 wherein said communicating means is selectively manipulable to selectively vary the treatment zones communicating with the second discharge assembly.

3. In a machine, an exhaust products handling apparatus according to claim 2 wherein the exhaust manifold includes a pair of opposed ends, the first discharge assembly being connected to the exhaust manifold at one opposed end thereof and the second discharge assembly being connected to the exhaust manifold at the other opposed end thereof.

4. In a machine, an exhaust products handling apparatus according to claim 3, and further comprising a plurality of outlet conduits each connecting a respective treatment zone to the exhaust manifold at a connecting location thereon, the connecting locations being at spaced intervals from one another along the extent of the exhaust manifold and the communicating means includes at least one flow blocking element movable between a blocking position for blocking the flow therepast of exhaust products at a blocking location on the exhaust manifold between an adjacent pair of the connecting locations at which the outlet conduits are connected to the exhaust manifold and a flow position at which the flow blocking element permits the flow of exhaust products past the blocking location.

5. In a machine, an exhaust products handling apparatus according to claim 4 wherein the communicating means includes a plurality of flow blocking elements each for selectively blocking the flow of exhaust products past an associated blocking position on the exhaust manifold between a respective adjacent pair of the connecting locations.

6. In a machine, an exhaust products handling apparatus according to claim 5 wherein each flow blocking element includes a throttle valve having a threaded stem portion and a blocking member connected to the threaded stem portion, each throttle valve being movably supported in the exhaust manifold and being operable to move its respective blocking member into a position in which it blocks the flow of exhaust products therepast and a position in which the blocking member does not completely block the flow of exhaust products therepast.

7. In a machine, an exhaust products handling apparatus according to claim 1 wherein the machine is a textile machine which applies heated air to a length of textile material in the treatment process and the discharge assembly includes means for producing suction to draw heated air out of those treatment zones with which it is communicated through the exhaust manifold.

8. In a machine, an exhaust products handling apparatus according to claim 7 and further comprising an exhaust product conditioning device, operatively connected to the discharge assembly, for conditioning heated air drawn out of treatment zones by the discharge assembly in a conditioning process in which selected components of the drawn out heated air are separated from other components thereof.

9. A method of handling exhaust products created during a treatment process in which treatment fluid is applied to a length of material, comprising:

manipulating a communicating means to communicate a first discharge assembly through an exhaust manifold with at least one selected treatment zone for drawing away exhaust products therefrom which are created during the application of treatment fluid to the length of material therein;

manipulating the communicating means to communicate a second discharge assembly through the exhaust manifold with at least one treatment zone not communicated with the first discharge assembly for drawing away exhaust products therefrom which are created during the application of treatment fluid to the length of material therein, the second discharge assembly having an exhaust products reconditioning device associated therewith for selectively removing or otherwise neutralizing pollutants comprised in the exhaust products handled thereby; and manipulating the communicating means to vary the treatment zones communicated with the first and second discharge assemblies.

* * * * *